US005947174A

United States Patent [19]

Woodham

[11] Patent Number: 5,947,174

[45] Date of Patent: Sep. 7, 1999

[54] DRUM DEBARKER OUTFEED SPOOL

[76] Inventor: Donald Van Woodham, 133 LakeFront Dr. Apt. 303, Daphne, Ala. 36526

[21] Appl. No.: 08/935,801

[22] Filed: Jul. 8, 1997

Related U.S. Application Data

[60] Provisional application No. 60/021,491, Jul. 10, 1996.

[51] Int. Cl.[6] ..... B27L 1/02; B27B 31/00

[52] U.S. Cl. ..... 144/208.9; 144/208.1; 144/245.2; 144/250.17; 144/250.25; 144/341

[58] Field of Search ..... 144/208.1, 208.9, 144/242.1, 250.17, 245.2, 340, 341, 250.25

[56] References Cited

U.S. PATENT DOCUMENTS

| | | | |
|---|---|---|---|
| 4,374,533 | 2/1983 | Svensson | 144/208.9 |
| 4,774,987 | 10/1988 | Sepling | 144/208.9 |
| 5,370,166 | 12/1994 | Mason | 144/245.2 |
| 5,669,428 | 9/1997 | Hoover | 144/208.9 |

*Primary Examiner*—W. Donald Bray
*Attorney, Agent, or Firm*—George L. Williamson

[57] ABSTRACT

An apparatus for debarking roundwood is provided which has a rotary drum debarker having conveyor means to move roundwood into and through the drum debarker, and, furthermore, has a rotable outfeed spool located at the outlet of the drum debarker to contact portions of the roundwood and help remove the roundwood from the drum debarker.

10 Claims, 4 Drawing Sheets

DRUM DEBARKER OUTFEED SPOOL

This application claims the benefit of U.S. Provisional Application No. 60/021,491, filed Jul. 10, 1996.

BACKGROUND OF THE INVENTION

This invention relates to the field of rotating drum debarkers for removing bark from logs and similar roundwood. More particularly, this invention relates to an improved means and/or method for more efficiently removing wood from the rotating drum debarker by using an outfeed spool.

Apparatuses and methods for debarking wood have been described in the prior art. For example, Applicant, in U.S. Pat. No. 5,005,621, described an improved rotating drum debarker for removing bark from logs and similar roundwood, particularly long roundwood, which included a conveyor chute to feed logs to the drum, wherein the drum included lifters and reinforcing rings where the reinforcing ring at the inlet and/or outlet of the drum had an inside diameter greater than the free inside diameter of the drum in order to improve the movement of logs through the drum. However, no means for aggressively removing the logs from the drum debarker were provided as does the present invention. The fact that there is no aggressive means to remove the logs from the drum debarker is a major disadvantage of this type of prior art drum debarker because the logs tend to become entangled with each other as they travel through and begin to exit the drum debarker and do not exit the drum debarker in as efficient a manner as would be provided by the present invention. This deficiency in the prior art is remedied by the present invention.

In a drum debarking system, logs are fed into the drum debarker horizontally via a power feeding system. As the power feed chain bed moves stems to the drum, a constant push is applied to the wood already in the drum debarker which forces debarked logs out into the drum discharge conveyor and then the chipper feed area. The power feed allows higher rates of production and more efficient debarking.

The drum debarker is supported by a metal framework. Drum speed is 0–12 rpm and has approximately 11% bark slot area. The drum can be operated in either clockwise or counter clockwise rotation. In a two drum arrangement, both drum shells are substantially identical and fully symmetrical so that they can be wear rotated for longer life.

The drum discharge conveyor incorporates the present invention, i.e., the Drum Debarker Outfeed Spool, which helps pull the debarked stems out of the drum debarker, and thereafter the drum discharge conveyor helps in singulation of wood to the chipper.

Controls for the plant are located in a stationary control cab positioned at a location where the operator can use line of sight to view debarking of wood in the drum and also direct the flow of wood into the chipper. A remote/electric controlled hydraulic loader assists the operator in handling problem logs.

Chipping is handled by a chipper that is driven by dual 600 hp electric motors. The motor shafts transmit torque to the chipper shaft via a dual belt drive. Soft start assemblies accomplish getting the motors up to speed within the local power company's demands.

Rotating drum debarkers of the type having lifters in the form of circumferentially spaced apart projections extending inwardly from the inner surface of the drum shell are well known. A typical debarking drum takes the form of a relatively thin cylindrical shell with the lifters welded to the inside of the shell, and with slots in the wall of the shell in the regions between the lifters for discharging removed bark from the drum. The lifters extend the length of the shell and serve to stiffen and reinforce the shell.

A typical lifter takes the form of a length of U,V, or L-shaped angle iron or channel with the ends of both its legs welded to the inside of the shell so the tip or peak of the lifter points toward the axis of the drum. A stiffening or reinforcing ring is secured to each end of the drum, and the ends of the lifters are usually welded to the inner side surfaces of these rings.

Thus, the lifters cooperate with the shell and the reinforcing rings to provide a beam reinforced skin structure which is quite strong even though the shell skin or side wall of the drum is relatively thin.

In the past, roundwood was cut to relatively short lengths for drum debarking because the short lengths were easy to handle with the available equipment. Tile trend today is toward debarking of tree length logs, and to provide long lengths which can be chipped more efficiently for pulpwood use, where the logs after debarking, are found to be unsuitable for use as lumber.

SUMMARY OF THE INVENTION

In drum debarking systems, wood (wood can be classified as any usable part of the primary stem of a tree, usually from 1' to 60' in length, which can be feasibly entered into the debarking drum) is debarked in a cylindrical steel drum shell which rotates.

The wood enters the debarking drum on one end, and by continuous feeding, is pushed through the length of the drum and exits on the other end. The rotation of the drum causes the pieces of wood to rub together removing the bark. The debarked wood exits the drum onto a conveyer that transports the material to the chipper for size reduction.

With the current industry practice, the conveyer that the material exits onto is typically 6" to 5' below the debarking drum lower I.D. lip in order that the wood will exit the debarking drum at least partly due to gravity. As the wood approaches the discharge end of this type of debarking drum, small pieces fall out due to gravity, long pieces stick out of the drum unsupported until which time their center of gravity allows them to angle down contacting the discharge conveyer. At this point the long pieces of wood are still partially inside the debarking drum and partially outside in the discharge area. Because they are angled downward, they are not parallel with other long pieces still fully inside the debarking drum and the pieces become intertwined. Due to the drum rotation and the intertwining of pieces much breakage occurs. The discharge area is violent and turbulent which is dangerous to the operator and damaging to the equipment.

In a system utilizing the present invention, the outfeed chain conveyer can be located approximately level with the lower lip of the debarking drum, and by doing this the wood remains parallel through and out of the drum. The tail roll assembly of the outfeed conveyer is adapted into an aggressive device, the Drum Debarker Outfeed Spool, which helps pull the wood out of the debarking drum and meters it onto the conveyer. The aggressive spool or roller or roll incorporates round plates or discs with irregular surfaces or teeth that rotate between the chain paths which plates rise above the conveyer surface. As the roll or spool turns, because the chains are moving forward, the raised, irregular plates grab the short and long pieces of wood and move them onto the outfeed conveyer. The tips of the raised, irregular plates act like teeth as they grab the pieces of wood and move them onto the outfeed conveyer. This system has been used in both 3 and 4 chain strand versions.

It is thus an object of the invention to provide an improved means and/or method for discharging pieces of wood from the drum debarker onto the discharge conveyer. It is a further object to provide a means and/or method for making the discharge area from the drum debarker onto the discharge conveyer to be a safer, less violent area by removing the pieces of wood more efficiently.

Another object of the invention is to increase production rate by more efficiently removing the pieces of wood from the drum debarker.

A further object is to decrease the amount of wood breakage and to more smoothly meter the flow of wood into the chipper.

DETAILED DESCRIPTION OF THE PREFERRED EMBODIMENT(S)

Figure 1:
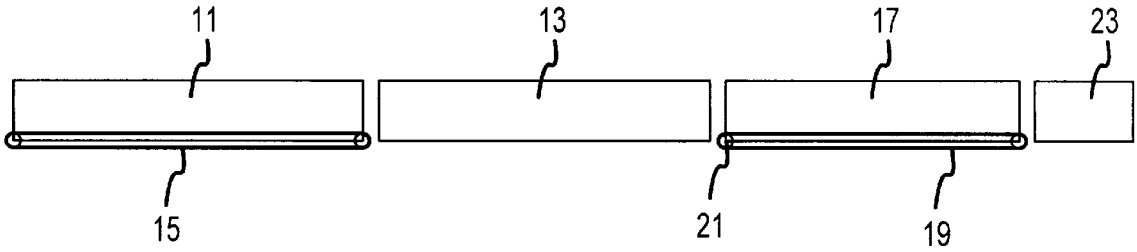
FIG. 1 is a schematic diagram of a log debarking process.

Turning to FIG. 1, therein is shown a schematic diagram of a drum debarking operation. Logs, i.e., wood, are placed onto the drum infeed, 11, and are carried toward and into the rotating debarking drum or drum debarker, 13, by a multi-stranded chain conveyor system, 15, located along the bottom of the drum infeed. The logs are conveyed from the drum debarker, 13, onto the drum discharge conveyer, 17, which, similarly to the drum infeed, 11, is equipped with a multi-strand chain conveyer system, 19, located in the bottom of the drum discharge conveyer. The present invention, the drum debarker outfeed spool, 21, is located at the entrance to the drum discharge conveyer, 17, and is driven by the same multi-stranded chain conveyer system, 19. Wood is then conveyed to the chipping system, 23, where the wood is cut into chips for reuse by various industries.

Figure 2:
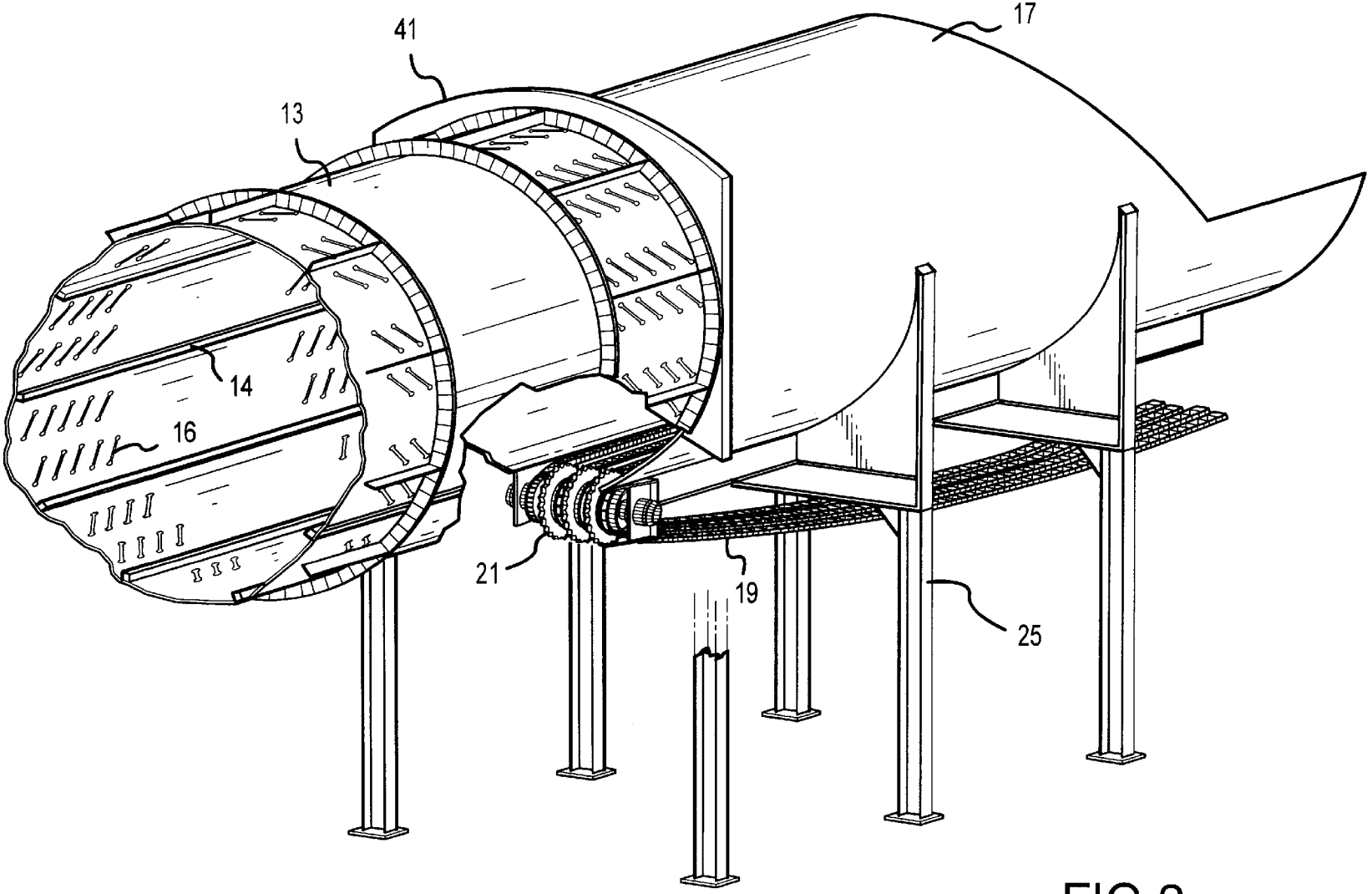
FIG. 2 is a perspective of an embodiment of the present invention shown in operative connection.

FIG. 2 shows the drum debarker, 13, the lifters, 14, on the inside of the drum debarker, the bark discharge slots, 16, the gate, 41, the drum discharge conveyer, 17, the multi-stranded outfeed chain conveyer system, 19, and the outfeed spool, 21, in operative connection. A support frame, 25, is also shown. FIG. 2 illustrates how the outfeed chain conveyer, 19, can be located approximately level with the lower lip of the drum debarker 13. This facilitates removal of wood from the drum debarker, 13, onto the drum discharge conveyer, 17, by allowing the drum debarker outfeed spool, 21, to remain in close contact with the wood pieces as they are removed from the drum debarker. The spool, 21, is fixedly mounted onto the support frame, 25.

Figure 3:
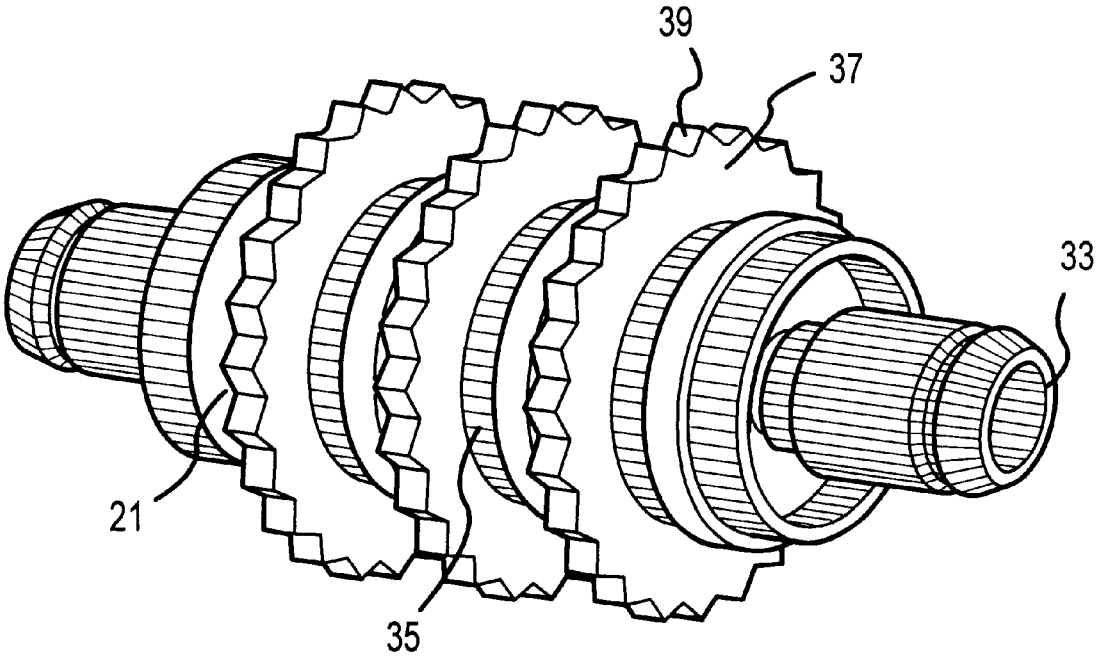
FIG. 3 is a perspective of an embodiment of the present invention.

FIG. 3 shows the outfeed spool, 21, along with its mounting shaft, 33, which shaft is rotably mounted onto the frame supporting the system incorporating some type of bearing and sleeve or like friction reducing means. Also shown are the multi-strand chain drive contacts or teeth, 35. The spool is equipped with round plates, 37, extending radially and spaced along its axis or shaft having irregular surfaces or teeth, 39, spaced along the edge of the outer circumference or periphery of the plates. In operation, it is the irregular surfaces or teeth, 39, which grab the pieces of wood and move them onto the outfeed conveyor. Note that plates, 37, are alternately positioned or interposed with the chain drive contacts, 35.

Figure 4:
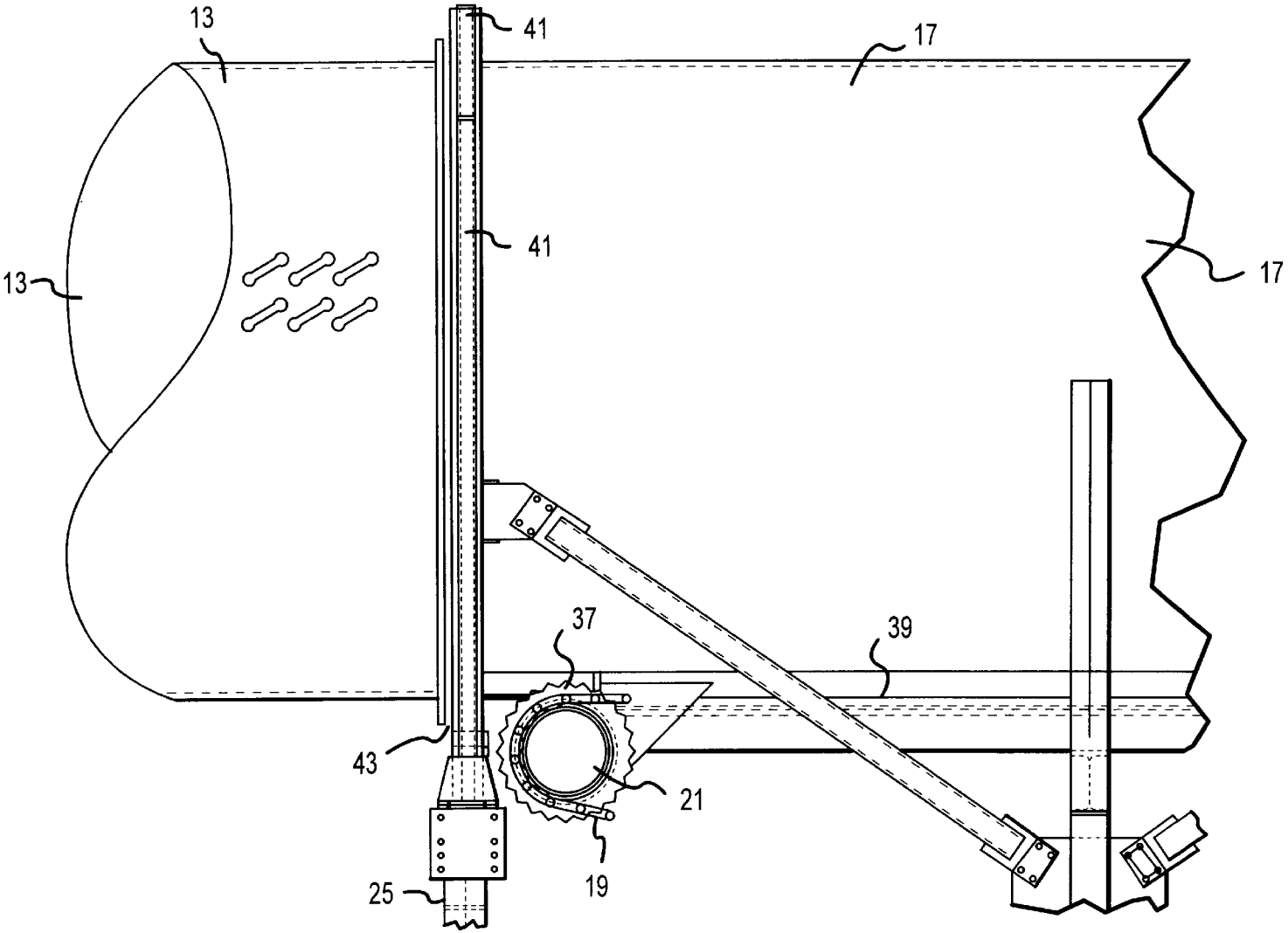
FIG. 4 is a side view in elevation of an embodiment of a system and apparatus according to the present invention.

FIG. 4 shows the drum debarker, 13, the drum discharge conveyor, 17, the chain conveyor system, 19, and the outfeed spool, 21. Also shown is the gate, 41, which controls the flow of wood from the debarking drum by varying the size of the opening into the drum discharge conveyor, 17. Note that the drum debarker, 13, and the drum discharge conveyor, 17, have a small space, 43, between them which allows the drum debarker to rotate unobstructed by the drum discharge conveyor, The support frame, 25, is also shown. FIG. 4 illustrates how the plates, 37, rise or project above the conveyor surface, 39.

Figure 5:
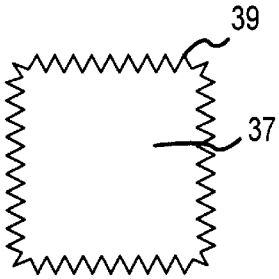
FIG. 5 is a side view in elevation of one embodiment of a plate according to the present invention.
Figure 6:
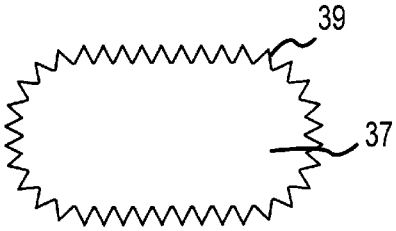
FIG. 6 is a side view in elevation of one embodiment of a plate according to the present invention.

FIGS. 5 and 6 show alternative shapes of the plates, 37, having teeth, 39, such that FIG. 5 shows a generally square shaped plate, 37, and FIG. 6 shows a generally oblong shaped plate, 37.

It should be understood that the teachings of this specification are given by way of illustration and explanation thereof and not by way of limitation because changes in the invention may be effected without departing from the scope and spirit of this invention as contained herein.

I claim:

1. An apparatus for debarking roundwood comprising:

(a) a generally horizontal rotary drum debarker having a drum with an inside surface through which roundwood is conveyed;

(b) said debarker having an inlet end and an outlet end;

(c) a first conveyor means being provided at said inlet end of said debarker for feeding roundwood into and through the inside of said debarker, (d) a second conveyor means being provided at said outlet end of said debarker for conveying roundwood from said debarker; and, (e) an outfeed means being provided at said outlet end of said debarker for positively contacting portions of roundwood and directing the roundwood out of said debarker onto said second conveyor means.

2. The apparatus of claim 1, wherein said outfeed means further comprises a fixedly mounted rotable outfeed spool for contacting portions of roundwood and directing the roundwood out of said debarker.

3. The apparatus of claim 2, wherein said rotable outfeed spool further comprises multiple plates extending radially from and spaced along its axis having teeth spaced along the periphery of said plates for contacting portions of the roundwood and directing the roundwood out of said debarker.

4. The apparatus of claim 2, wherein said rotable outfeed spool is round shaped.

5. The apparatus of claim 2, wherein said rotable outfeed spool is square shaped.

6. The apparatus of claim 2, wherein said rotable outfeed spool is oblong shaped.

7. The apparatus of claim 1, further comprising said outfeed means for pulling roundwood out of said debarker by contacting portions of roundwood and directing the roundwood out of said debarker.

8. The apparatus of claim 1, wherein said outfeed means project above said second conveyor means for contacting portions of roundwood and directing the roundwood out of said debarker.

9. The apparatus of claim 2, wherein said fixedly mounted rotable outfeed spool projects above said second conveyor means for contacting portions of roundwood and directing the roundwood out of said debarker.

10. The apparatus of claim 3, wherein said multiple plates project above said second conveyor means for contacting portions of roundwood and directing the roundwood out of said debarker.

* * * * *